US006935738B2

(12) United States Patent
Lorenz et al.

(10) Patent No.: US 6,935,738 B2
(45) Date of Patent: Aug. 30, 2005

(54) INK-JET PRINTER AND METHOD FOR PRINTING IMAGE MATERIAL IN AN INK-JET PRINTER

(75) Inventors: Bernhard Lorenz, Marzling (DE); Peter Mueller, Tratteistr (DE); Knut Oberhardt, Foeching (DE); Gudrun Taresch, Munich (DE)

(73) Assignee: AgfaPhoto GmbH, Leverkusen (DE)

( * ) Notice: Subject to any disclaimer, the term of this patent is extended or adjusted under 35 U.S.C. 154(b) by 152 days.

(21) Appl. No.: 10/343,585

(22) PCT Filed: Jun. 19, 2001

(86) PCT No.: PCT/EP01/06877

§ 371 (c)(1),
(2), (4) Date: Jan. 31, 2003

(87) PCT Pub. No.: WO02/11987

PCT Pub. Date: Feb. 14, 2002

(65) Prior Publication Data

US 2004/0036738 A1 Feb. 26, 2004

(30) Foreign Application Priority Data

Aug. 3, 2000 (DE) ..... 100 37 948

(51) Int. Cl.[7] ..... B41J 2/01
(52) U.S. Cl. ..... 347/104; 400/579
(58) Field of Search ..... 347/104, 102; 400/579

(56) References Cited

U.S. PATENT DOCUMENTS 4,215,353 A * 7/1980 Kaieda et al. ..... 347/6
4,952,950 A 8/1990 Bibl et al.
5,479,585 A 12/1995 Komagine
5,757,407 A * 5/1998 Rezanka ..... 347/102
5,815,282 A 9/1998 Kano
5,871,292 A 2/1999 Johnson et al.
5,912,681 A * 6/1999 Uetuki et al. ..... 347/29
6,003,988 A 12/1999 McCann et al.

FOREIGN PATENT DOCUMENTS

| | | | | |
|---|---|---|---|---|
| DE | 30 48 716 | A1 | 9/1981 | |
| DE | 37 28 945 | A1 | 5/1989 | |
| DE | 41 20 293 | A1 | 2/1992 | |
| DE | 41 10 776 | A1 | 10/1992 | |
| DE | 199 04 745 | A1 | 8/1999 | |
| EP | 0 264 266 | B1 | 3/1994 | |
| EP | 0 598 251 | A1 | 5/1994 | |
| EP | 0 665 114 | A2 | 8/1995 | |
| EP | 0 952 003 | A1 | 10/1999 | |
| GB | 2 152 436 | A | 8/1985 | |
| JP | 63112180 | A * | 5/1988 | ..... B41J/15/04 |

* cited by examiner

*Primary Examiner*—Stephen D. Meler
*Assistant Examiner*—Ly T Tran
(74) *Attorney, Agent, or Firm*—Milde & Hoffberg, LLP

(57) ABSTRACT

The invention relates to a method for printing image material (2), which lies on top of a sheet carrier (1), in an inkjet printer. The inkjet printer comprises an inkjet print head (6), which only partially covers the image material (2). The image material (2) is printed during a temporally successive relative movement, occurring in the x and y directions, between the inkjet print head (6) and the sheet carrier (1).

27 Claims, 3 Drawing Sheets

INK-JET PRINTER AND METHOD FOR PRINTING IMAGE MATERIAL IN AN INK-JET PRINTER

BACKGROUND OF THE INVENTION

The present invention relates to a method for printing image material in an inkjet printer. In addition, the invention relates to a device for carrying out the method.

The U.S. Pat. No. 6,003,988 discloses an inkjet printer that can be used to print on moving paper. However, a high-precision paper feed is required in order to print accurately on the moving paper. The paper feed should essentially be isolated from vibrations, such that the same advance between the printed lines is always ensured and no density fluctuations occur. This is because the human eye is very sensitive to such errors. However, such high precision feed devices are very elaborate and expensive.

Furthermore, inkjet printers are known that are equipped with an inkjet print head that covers the image material to be printed on its entire width, such that an entire line can be created without a movement of the inkjet print head. However, such inkjet print heads are expensive due to their special manufacture.

Finally, for industrial digital printing machines, a two-dimensional arrangement of print heads is known, where several print heads with the same ink color are arranged adjacent to one another in the scan direction (y direction) and of different ink colors perpendicular to the scan direction (x direction). However, such an arrangement necessitates a relatively long print carriage reducing the print capacity because of the adverse ratio between scan path and utilizable print path. In addition, this arrangement includes the risk of inks from several print heads bleeding into each other, because different colors are printed right after each other, and especially with fast printing, the ink of the previous print heads has not yet dried when the next color is printed. With bi-directional printing, mixed colors may look different because the application of the inks onto the image material occurs in a different order.

SUMMARY OF THE INVENTION

Therefore it is the objective of this invention to eliminate the disadvantages of the aforementioned state-of-the-art and, in particular, to enable a precise application of the image data onto the image material using an inexpensive inkjet printer.

This objective, as well as other objectives which will become apparent from the discussion that follows, are achieved, in accordance with the present invention, by providing a method for printing image material, which lies on a sheet carrier in an ink-jet printer with an ink-jet print head, which only partially covers the image material, wherein either the ink-jet print head moves in x and y directions across the image material, or the sheet carrier moves in x and y directions under the ink-jet print head, or the image material is printed during a temporally successive relative movement, occurring in the x and y directions, between the ink-jet print head and the sheet carrier.

A particular advantage of the present invention is the significant cost savings due to the use of commercially available inkjet print heads, because no special manufacture of print heads is necessary as is the case with so-called "page wide array print heads" that cover the image material in its full width.

While printing, the image material is preferably held positioned exactly on the sheet carrier, in particular in a contact-free manner, e.g., through suction, such that a precise application of the image data onto the image material is ensured.

Different variations are possible for creating the relative movement, according to the invention, between the inkjet print head and the sheet carrier. According to one advantageous embodiment, the inkjet print head can be moved in the x and y direction across the image material for this purpose. Thus, the movement occurs in two not necessarily orthogonal directions, such that, after the printing procedure, the image material is printed on entirely. In this manner, any relative position of the inkjet print head in relation to the image material can be achieved. Alternatively, the sheet carrier can also be moved in the x and y direction under the inkjet print head or the inkjet print head can be moved in one direction and the sheet carrier in the other direction. The most advantageous of the aforementioned embodiments is the one where the print head is moved in the x and y directions, because especially with large sheet carriers, the movement of the sheet carrier requires much space and, in addition, more mass needs to be moved. If the sheet carrier and the print head are both moved, these movements should occur succinctly so that successive lines are printed precisely next to one another.

According to one advantageous improvement, the inkjet print head contains three or more print heads that are moved parallel to one another and positioned one behind the other in the x direction across the sheet carrier. This arrangement of being positioned one behind the other has the advantage that a very fast print speed can be selected without this leading to a mixing of the colors because each printed point is not overlaid with a different color until the next line.

With this method according to the invention, it is preferred that each print line be printed several times. A higher resolution can be achieved in this manner.

In particular, when the movement of the sheet carrier occurs under the inkjet print head in x and y directions, it is useful, if, at each line feed, the sheet carrier is advanced only by a portion of the head width of the inkjet print head. This avoids or minimizes the density fluctuations that occur when the previous and the subsequent lines are not printed seamlessly one after the other.

In order to avoid the aforementioned density fluctuations, or to minimize them even further, according to an additional advantageous improvement, it is provided that the movement of the inkjet print head and/or the sheet carrier occurs in a zigzag or meandrous pattern.

To minimize density fluctuations, it is furthermore advantageous to allow overlapping of the previous and subsequent lines, using a so-called "micro-weaving" method. With this method, not all pixels at the edge of the line are written in the previous line; instead, the ones left blank are filled in the subsequent line.

According to one preferred embodiment, printing onto the image material occurs while image material already printed on is being dried. For this purpose, either the sheet carrier must exhibit a respective size, which enables faster processing, in particular of image material with smaller formats, and also ensure the processing of larger format image material, or several sheet carriers must be provided, across which the inkjet print head must be moved, such that a sheet carrier can be loaded or unloaded, while printing still occurs on another sheet carrier, leading to faster processing times.

The image material is advantageously secured on the sheet carrier using a conveyor belt with suction. This allows for fixed positioning of the image material during printing and feeding of the image material while it is being printed on and when printing is finished.

Preferably, a suction device is used for placing and removing the image material, because such a suction device handles the image material in a very gentle manner. Alternatively, feeder roles can also be imagined.

To reduce costs, it is advantageous to accommodate this suction device on the print head carriage. The travel range of the head must then be increased accordingly.

In order to ensure a precise application of the image data onto the image material, a preferred improvement provides that position data of the image material are gathered, from which the control data for positioning of the image material in relation to the inkjet print head are obtained.

To minimize the effort for positioning image material and an inkjet print head, and to have the image material on the sheet carrier already arranged as exactly as possible, the image material is preferably aligned in front the sheet carrier using a mechanical centering device.

To fully use the width of the sheet carrier, especially when processing smaller formats, a preferred embodiment provides that several rows of image material can be printed while positioned adjacent to one another. To this end, a path distributor that can generate several rows of image material is preferably located in front of the sheet carrier.

It is preferable that a drier for drying the already printed image material be activated at each print position.

The objectives of the present invention with regard to an ink-jet printer apparatus are achieved, according to the present invention, by providing a transport device for moving the ink-jet print head across the image material in the x and y directions, or moving the sheet carrier relative to the print head in x and y directions, or for moving the sheet carrier and the print head successively with regard to time and relative to one another in the x and y directions.

This solution results in a simple and inexpensive device that enables the movement of the inkjet print head, or that of the sheet carrier, respectively, without great effort and in the smallest possible space.

Several options can be imagined in order to implement the solution subject to the invention. The device may be designed such that either the inkjet print head or the sheet carrier can be moved back and forth in the x and y directions, or that the sheet carrier can be moved in one direction and the inkjet print head in the other.

If the inkjet print head moves in the x and y direction, the movement of the inkjet print head is preferably realized such that the inkjet print head can be moved back and forth in the y direction supported by a guide rail that can be moved in the x direction. This design allows for an inexpensive and space-saving implementation of the method according to the invention.

In this case, the inkjet print head is preferably designed such that the inkjet print head consists of several print heads that are positioned behind one another in the x direction. According to a further improvement, these print heads can be arranged in two parallel rows. In this case, it is advantageous if the print heads of the first row are offset in relation to the position of the print heads in the second row. This design offers the advantage that the width of the print carriage can be kept to a minimum thereby increasing the ratio of the scan path to the useable print path. This results in a significant increase in productivity of the entire device. Since furthermore the image material to be printed on is advanced after each scan procedure of the print carriage, there is a significantly greater time span between the different color printings on one position on the paper. This allows the ink to dry and the risk of colors bleeding is significantly reduced. With bi-directional printing, the application of the various colors always occurs in the same order, such that no different mixed colors are generated.

Preferably, the sheet carrier consists of a hydrophobic conveyor belt with suction.

This has the advantage that ink splatters that hit the sheet carrier during margin-less printing can be removed easily and that through the conveyor belt with suction the image material can be drawn up and the ink splashes can be sucked off.

According to a preferred improvement, a path distributor can be arranged in front of the sheet carrier, such that several rows of image materials can be placed simultaneously on the sheet carrier.

It is advantageous that a drying zone follows the printing zone, so that the sheet carrier runs through both the printing zone and the drying zone. This eliminates the need for the process where the image material is initially taken up by the sheet carrier which then needs to place it on a conveyor to move the image material through the dryer.

For the printing of the image material to occur in the correct position, a preferred embodiment provides a sensor unit in the area of the inkjet print head for detecting the position data of the image material, which sensor unit preferably has a fixed connection to the print head. In this manner, optimum printing is ensured even with image material positioned at an angle.

For a full understanding of the present invention, reference should now be made to the following detailed description of the preferred embodiments of the invention as illustrated in the accompanying drawings.

DESCRIPTION OF THE PREFERRED EMBODIMENT

Figure 1:
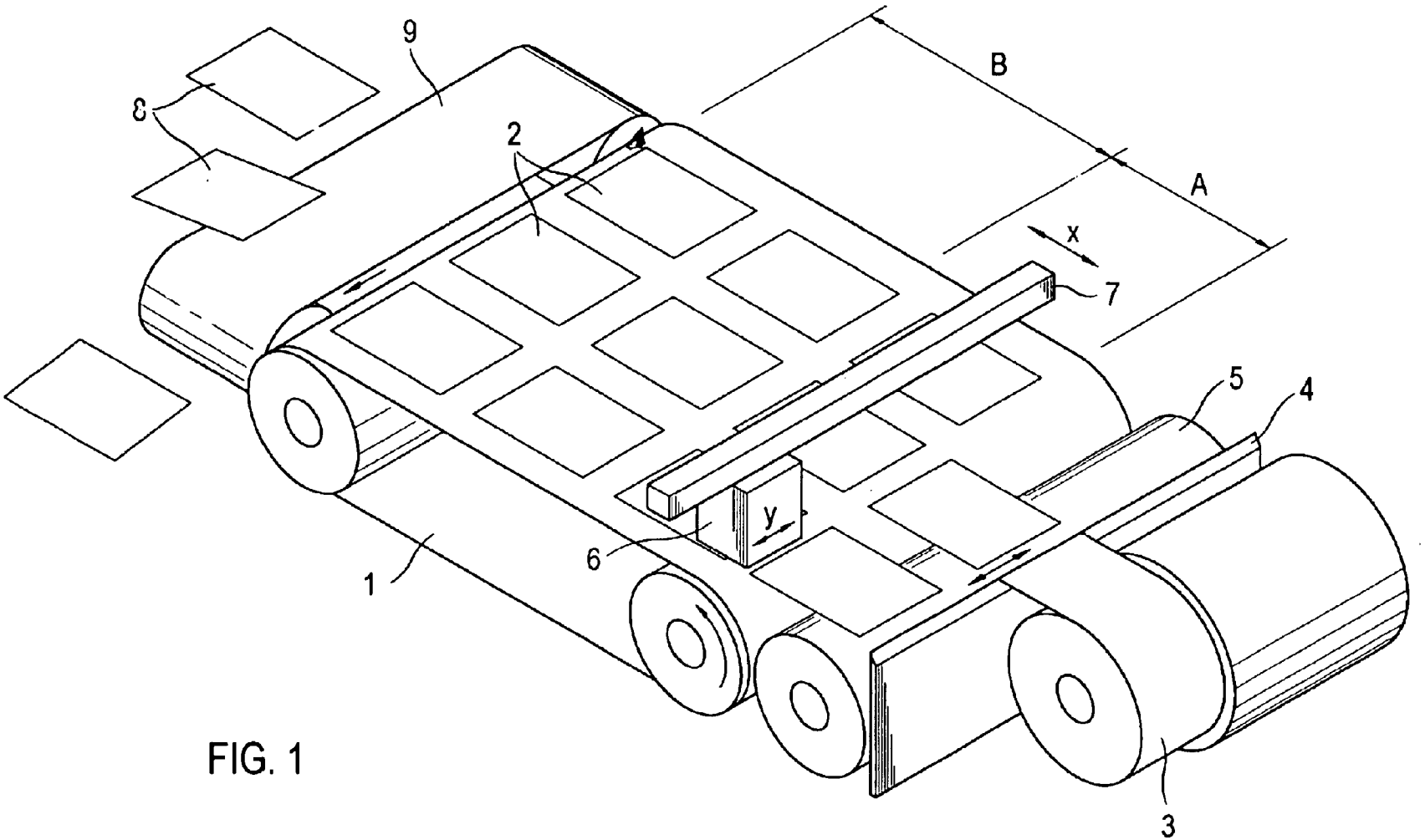
FIG. 1 shows a device for carrying out the method according to the invention.

The preferred embodiment of the present invention will now be described with reference to FIGS. 1–2 of the drawings. Identical elements in the two figures are designated with the same reference numerals.

FIG. 1 presents a device according to the invention for carrying out the method according to the invention. One can recognize a sheet carrier 1, which in this present case is designed as a hydrophobic conveyor belt with suction that circulates using two rollers (not shown). Several rows of image material 2 are located on the sheet carrier 1.

The image material 2 is drawn from an continuous paper roll 3, is cut according to the desired formats by a knife 4, and thereafter conveyed in the desired number of paths onto the sheet carrier 1 using a path distributor 5.

The path distributor 5 can also move parallel to the conveyor belt, such that the sheets to be printed are taken up at the beginning of the conveyor belt by means of suction units, printed on while on the conveyor belt and, at the end of the conveyor belt, the printed sheets are again placed onto the path distributor 5 for removal.

Inkjet print head 6 is located above the sheet carrier 1 and is supported by a guide rail 7 that stretches across the entire width of the sheet carrier 1. The inkjet print head 6 can be moved in the y direction back and forth across the sheet carrier 1 perpendicular to the feed direction of the image material 2. The guide rail 7 can be moved back and forth in the x direction, that is, in the feed direction of the image material 2.

A sorter 8 that sorts the printed image material 2 in a respective manner can be provided behind the sheet carrier 1. The sorter may be operated via a conveyor device 9.

The zone that the sheet carrier passes through is divided into a printing zone A and a drying zone B. In the drying zone B, a drier device (not shown) is provided.

Figure 3:
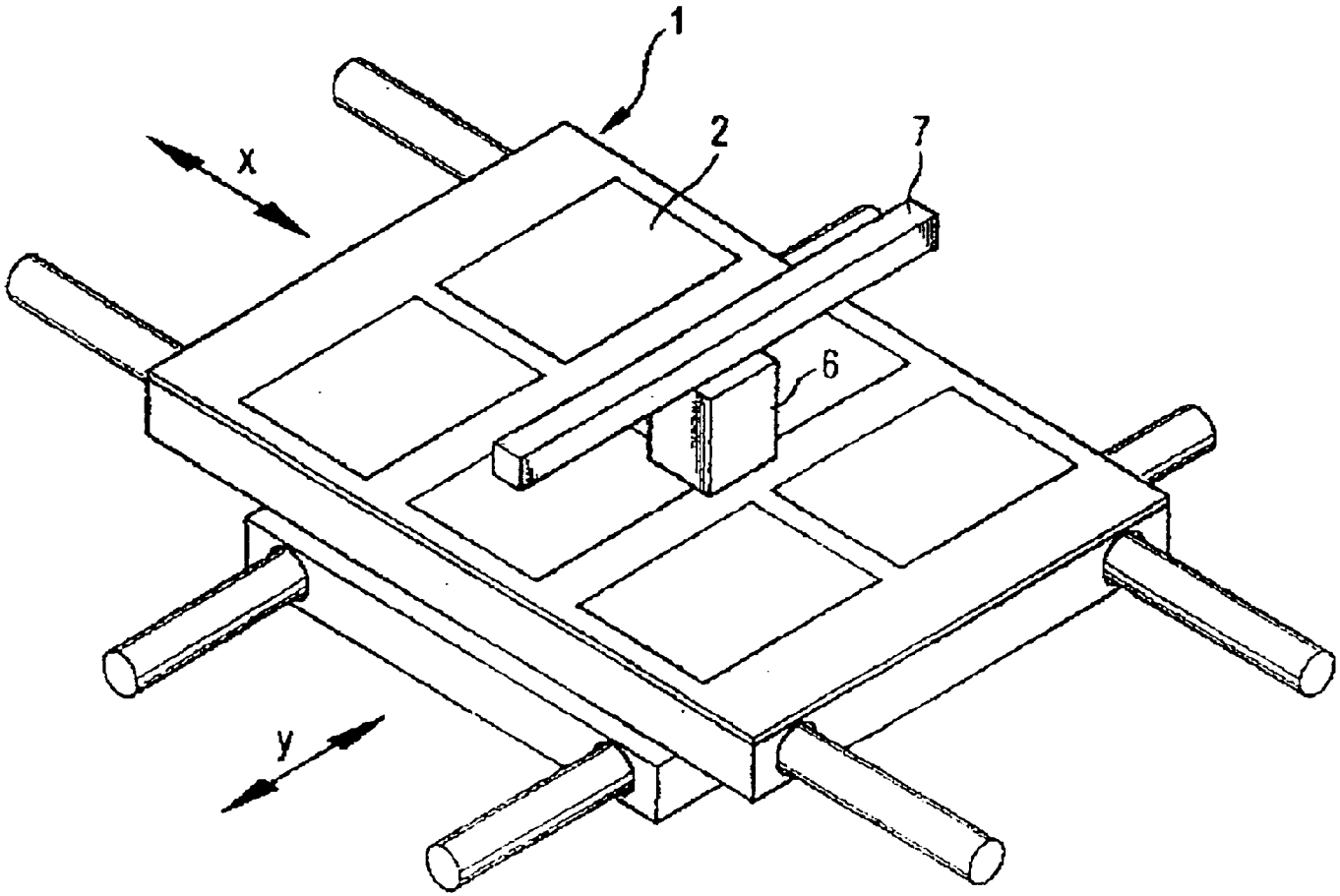
FIG. 3 shows a further device for carrying out the method according to the invention.

Instead of moving the inkjet print head 6 in x and y direction across the sheet carrier 1 as shown, the sheet carrier 1 can be moved in x and y direction under the inkjet print head, as shown in FIG. 3. Alternatively, it is also possible that the inkjet print head 6 carries out the movement in one direction and the sheet carrier 1 the movement in the other direction. An x/y-stage that may also be equipped with suction holes can also serve as the sheet carrier; and again, the print head 6 can move across the x/y-stage, or said x/y-stage can move in relation to the print head. It is advantageous for the sheet carrier 1 to be moved as one unit in a fixed guide because this will allow for the most defined and most precise movement.

Figure 2:
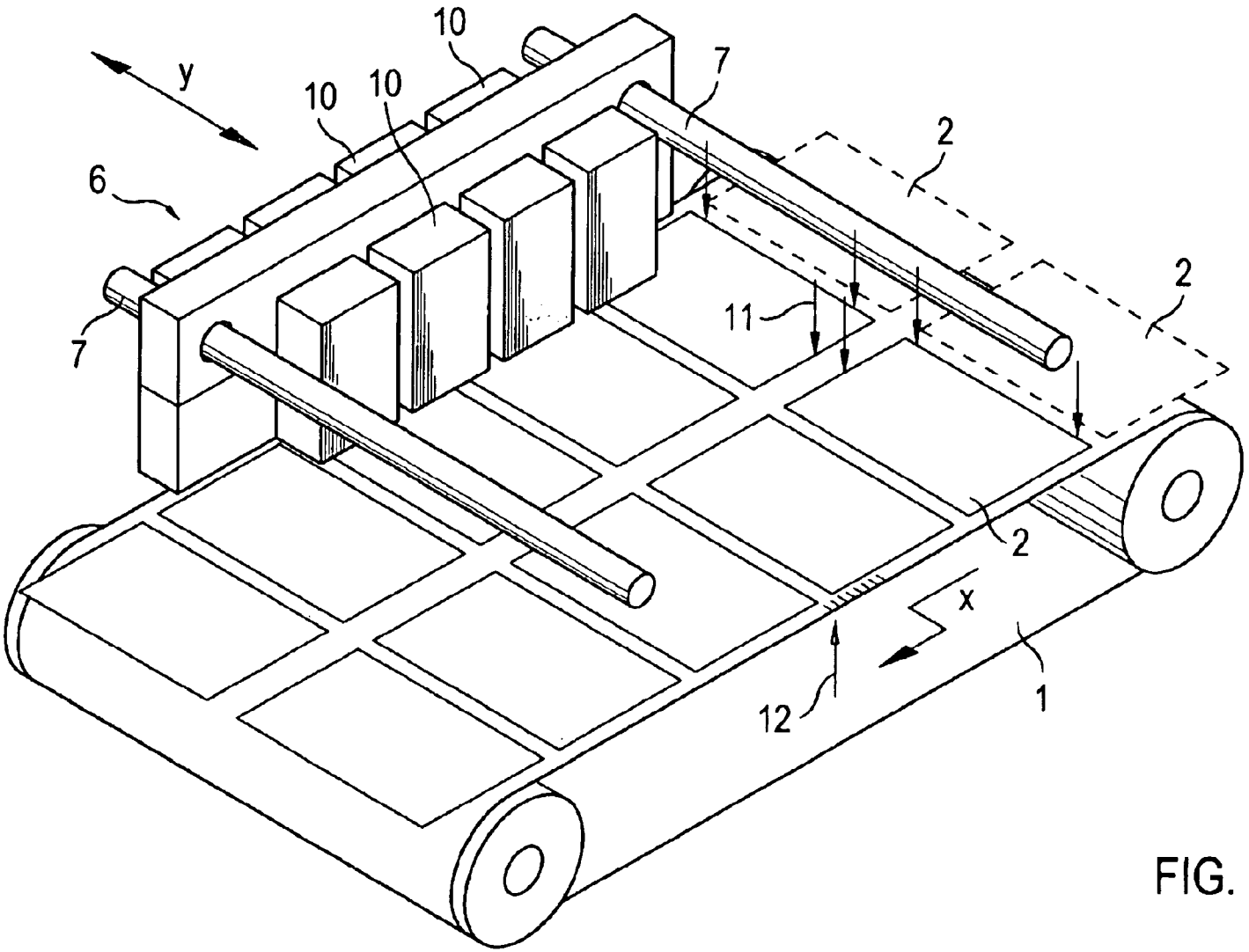
FIG. 2 shows an inkjet print head used in the device according to the invention of FIG. 1.

FIG. 2 shows in detail an inkjet print head 6 that may be used in the device according to the invention.

Here too, one can recognize the sheet carrier 1 with two rows of image material 2 arranged on it. The inkjet print head 6, which is supported by a guide rail 7 in a fashion that it can move back and forth in the y direction, is located above the sheet carrier 1. The guide rail 7, which here consists of two bars, can be moved back and forth in the x direction using a device (not shown).

The inkjet print head 6 consists of several individual print heads 10 that are arranged in two rows in the x direction behind one another. The print heads 10 of the one row are offset in relation to the print heads 10 of the other row.

A sensor unit 11, which senses the position data of the image material 2 located on the image carrier 1, is provided in front of the inkjet print head 6. In FIG. 2, numerous short arrows indicate this sensor unit 11.

In addition, a sensor 12, which detects the exact position of the sheet carrier 1 through respective markings on said sheet carrier, may be provided at the sheet carrier 1.

There has thus been shown and described a novel ink-jet printer and method for printing image material in an ink-jet printer which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A method for printing image material, which lies on a sheet carrier in an inkjet printer with an inkjet print head, which only partially covers the image material, the improvement wherein the inkjet print head moves in x and y directions across the image material, and wherein the image material is precisely positioned and held, only on its rear side, to the sheet carrier.

2. A method for printing image material, which lies on a sheet carrier in an inkjet printer with an inkjet print head, which only partially covers the image material, wherein the sheet carrier moves in x and y directions under the inkjet print head, and wherein the image material is precisely positioned and held, only on its rear side, to the sheet carrier.

3. A method as set forth in one of claims 1 and 2, wherein the inkjet print head contains three or more print heads that are moved, relative to the sheet carrier, parallel to one another and in x direction behind one another.

4. A method as set forth in one of claims 1 and 2, wherein each print line is printed several times.

5. A method as set forth in one of claims 1 and 2, wherein at each line feed the sheet carrier is moved relative to the inkjet print head by only a portion of the width of said inkjet print head.

6. A method as set forth in one of claims 1 and 2, wherein printing of the image material occurs while already printed image material is being dried.

7. A method as set forth in one of claims 1 and 2, wherein the image material is secured on the sheet carrier using a conveyor belt with suction.

8. A method as set forth in one of claims 1 and 2, wherein the image material is placed on the sheet carrier using a suction unit.

9. A method as set forth in claim 8, wherein the suction unit is located close to the inkjet print head.

10. A method as set forth in one of claims 1 and 2, wherein position data of the image material are detected for the exact application of image data onto the image material and wherein control data for the mutual positioning of the image material and the inkjet print head are obtained from said position data.

11. A method as set forth in one of claims 1 and 2, wherein the image material is aligned using a mechanical centering device arranged ahead of the sheet carrier in the direction of movement of the image material.

12. A method as set forth in one of claims 1 and 2, wherein several rows of image material are printed while arranged adjacent to one another.

13. A method as set forth in one of claims 1 and 2, wherein the several rows of image material are generated by a path distributor that is located in front of the sheet carrier.

14. A method as set forth in one of claims 1 and 2, wherein a dryer for drying the already printed image material is activated at each print position.

15. A method as set forth in one of claims 1 and 2, wherein the image material is held by suction on the sheet carrier.

16. An inkjet printer for printing image material, with a sheet carrier, on which lies the image material, and with an inkjet print head, which only partially covers the image material, the improvement comprising a transport device for moving the inkjet print head across the image material in x and y directions, and wherein the sheet carrier includes means for precisely positioning and holding the image material only on its rear side.

17. An inkjet printer for printing image material, with a sheet carrier, on which lies the image material, and with an inkjet print head, which only partially covers the image material, the improvement comprising a transport device for moving the sheet carrier relative to the print head in x and y directions, and wherein the sheet carrier includes means for precisely positioning and holding the image material only on its rear side.

18. A device as set forth in one of claims 16 and 17, wherein the inkjet print head comprises several print heads arranged in the x direction behind one another.

19. A device as set forth in claim 18, wherein the print heads are arranged in two parallel rows.

20. A device as set forth in claim 18, wherein the print heads of the first row are positioned offset to the print heads of the second row.

21. A device as set forth in one of claims 16 and 17, wherein the sheet carrier comprises a hydrophobic conveyor belt with suction.

22. A device as set forth in one of claims 16 and 17, further comprising a path distributor located in front of the sheet carrier.

23. A device as set forth in claim 22, further comprising suction units for transferring the sheets from the path distributor to the sheet carrier.

24. A device as set forth in claim 23, wherein the suction units are located close to the inkjet print head.

25. A device as set forth in one of claims 16 and 17, wherein the sheet carrier moves through a drying zone that is located following the printing zone.

26. A device as set forth in one of claims 16 and 17, further comprising a sensor unit for detecting the position data of the image material in the area of the inkjet print head.

27. A device as set forth in one of claims 16 and 17, wherein said means for holding the image material on the sheet carrier comprises means for producing suction.

* * * * *